US007052055B1

(12) United States Patent
Castro Netto

(10) Patent No.: US 7,052,055 B1
(45) Date of Patent: May 30, 2006

(54) FASTENING-TYPE SECURITY SEAL

(75) Inventor: Eduardo De Lima Castro Netto, deceased, late of Rio de Janeiro (BR); by Lydia de Faria Lima Castro, legal representative, Rio de Janeiro (BR)

(73) Assignee: ELC Produtos de Seguranca Industria e Comerico LTDA., Rio de Janeiro (BR)

( * ) Notice: Subject to any disclaimer, the term of this patent is extended or adjusted under 35 U.S.C. 154(b) by 0 days.

(21) Appl. No.: 10/221,654

(22) PCT Filed: Apr. 3, 2000

(86) PCT No.: PCT/BR00/00028

§ 371 (c)(1),
(2), (4) Date: Aug. 19, 2003

(87) PCT Pub. No.: WO01/75842

PCT Pub. Date: Oct. 11, 2001

(51) Int. Cl.
*B65D 55/06* (2006.01)

(52) U.S. Cl. ..... 292/307 A; 292/307 R; 24/16 PB; 24/30.5 P; 24/30.5 R

(58) Field of Classification Search ..... 292/307 A, 292/307 R; 24/30.5 R, 30.5 P, 16 PB
See application file for complete search history.

(56) References Cited

U.S. PATENT DOCUMENTS

| | | | | |
|---|---|---|---|---|
| 2,911,743 | A | 11/1959 | Pokras | |
| 3,106,028 | A | 10/1963 | Baumgartner | |
| 3,197,899 | A | 8/1965 | Twentier | |
| 3,322,325 | A * | 5/1967 | Bush | 383/71 |
| 3,994,085 | A * | 11/1976 | Groselak et al. | 40/665 |
| 4,078,324 | A | 3/1978 | Wiebe | |
| 4,272,900 | A | 6/1981 | Macarty et al. | |
| 4,285,146 | A | 8/1981 | Charles et al. | |
| 4,470,173 | A * | 9/1984 | Adamson | 24/30.5 P |
| 4,501,049 | A * | 2/1985 | Adamson | 24/30.5 P |
| 4,506,415 | A | 3/1985 | Swift | |
| 4,537,432 | A * | 8/1985 | Meeks | 292/318 |
| 4,630,384 | A * | 12/1986 | Breen | 40/665 |
| 4,787,158 | A * | 11/1988 | Vitol | 40/638 |
| 4,914,843 | A | 4/1990 | DeWoskin | |
| 5,337,503 | A * | 8/1994 | Goby | 40/665 |
| 5,382,528 | A * | 1/1995 | Scoville | 436/1 |
| 5,441,316 | A * | 8/1995 | Georgopoulos | 292/320 |
| 5,524,945 | A * | 6/1996 | Georgopoulos et al. | 292/307 A |

(Continued)

FOREIGN PATENT DOCUMENTS

| | | |
|---|---|---|
| BR | 8906110-1 | 4/1991 |

(Continued)

*Primary Examiner*—Brian E. Glessner
*Assistant Examiner*—Carlos Lugo
(74) *Attorney, Agent, or Firm*—Smith Gambrell & Russell LLP

(57) ABSTRACT

A fastening-type security seal comprises a sealing body for sealably receiving the free end of an elongated fastening portion and an identification tag, all integrated, one with the other. The identification tag is formed with a weakening line extending from a first side edge to a second side edge of the tag, dividing it into a first region on one side and a second region on the other side of the line. The identification tag is positioned between the sealing body and the fastening part so that, in use, the tag effectively forms part of fastening portion. A pulling tab is situated on the identification tag adjacent one of the ends of the weakening line, which enables one to tear the tag, thus separating the first region from the second region.

18 Claims, 2 Drawing Sheets

U.S. PATENT DOCUMENTS 5,542,724 A * 8/1996 Netto ..... 292/317
5,765,885 A * 6/1998 Netto ..... 292/318
5,878,520 A * 3/1999 Milbrandt et al. ..... 40/665
5,895,075 A * 4/1999 Edwards ..... 283/81
6,055,756 A * 5/2000 Aoki ..... 40/633
6,328,356 B1 * 12/2001 Aichmann ..... 292/318
6,343,819 B1 * 2/2002 Shiozaki ..... 292/307 R
6,490,821 B1 * 12/2002 Lacek ..... 40/673
6,546,652 B1 * 4/2003 Gardner et al. ..... 40/302
6,667,091 B1 12/2003 Castro Netto
6,695,364 B1 * 2/2004 Bierlin ..... 292/307 A
6,789,341 B1 * 9/2004 Badura ..... 42/70.11

FOREIGN PATENT DOCUMENTS

EP 0 676 736 10/1995
EP 0 908 863 4/1999

* cited by examiner

FASTENING-TYPE SECURITY SEAL

This invention refers to a fastening-type security seal made from a single piece of plastic material. This type of seal has a sealing body forming a tunnel, provided internally with at least one tooth, and an elongated part, or flexible strap, with one end as an integral part of the body, and the other end free. Along the elongated part a series of sealing formations is provided, so that, when the free end is inserted into the tunnel of the sealing body and pulled out at the other end of the tunnel, the sealing formations successively engag with the tooth in a ratchet-like manner to prevent withdrawal of the strap part from the tunnel.

Security seals of the type mentioned above are widely used, including as fasteners. However, when they are used as security seals, an identification tag, usually forming an integral part of the body, serves to personalize the seal by means of a number and/or bar code. The tag is located on the side of the body opposite that of the elongated or fastening part.

In practice, there are two drawbacks in this well-known type of seal. First, it is essential that the fastening part present considerable strength in the longitudinal direction, in view of the use of the device as a fastener, that is to say, the seal is tightened around the object that is being closed. It is evident that a low-resistance part of the fastener would run the risk of breaking during normal use. Thus, when it is desired to open the closed object, it is necessary to break the fastening part. This is done by cutting it with a pair of scissors, a knife or the like. In addition to the inconvenience of the need for scissors or knife to cut th seal, the pair of scissors or knife itself may damage the closed object, thus rendering it useless for subsequent use. For instance, if the object is a mail or money bag, a cut would make it useless forev r, since any repair would be seen as tampering with the bag.

Another drawback is that the identification tag projects out of the closed bag.

This type of security seal is exemplified in Pat. PI 8906110-1.

The first drawback was partly overcom in some seals by weakening the fastening part, thus allowing the latter to be broken by hand at the time of opening. However, in order to maintain the physical strength of the fastening part at a level compatible with the use of the device, the physical effort required for breaking the fastening part is excessive and may injure the fingers of the user. In addition, with a view to avoiding the excessive weakening of the fastening part, a thickening of the fastener in the region of the weakening has been created. This results in an increase in the amount of raw material (plastic) and, consequently, the manufacturing cost.

The objective of this invention is to provide a security seal of the above-mentioned type, which can be removed from a bag by means of destruction thereof, without the need for resorting to a cutting instrument, without weakening the fastening part and without increasing the amount of raw material. Instead, the invention provides a decrease in the amount of raw material used in manufacturing the seal. The seal of this invention may be destroyed and removed from the closed object totally by hand. In addition, the identification tag no longer projects out of the closed object, remaining attached, flush with the latter and used to reduce the length of the fastening part.

According to this invention, a security seal of the type described above is characterized by the fact that:

a) the tag features a weakening line extending from the first edge to the second edge of the tag, dividing the tag into one region on one side of the line and a second region on the other side of the line;

b) the sealing body is integrated with the first region of the tag;

c) the fastening tag is integrated with and extends from the second region of the tag; and d) means of tearing are present on the tag, adjacent to one of the ends of the weakening line, which enable one to tear the tag, separating the first region from the s cond region.

It is preferable that the first and second edges of the tag b opposite edges, the tear line being generally diagonal with respect to the tag and the tear line, comprising a groove on the side of the tag designed to face the object being closed.

It is understood that the identification tag will be located between the sealing body and the fastening part. In this way, the fastening part will be shortened by an extent equal to the dimension, in the longitudinal direction, of the tag, reducing the amount of raw material used.

In addition, since the weakening line extends over at least the width of the tag, it is much longer than the weakening region would be if it were made on the fastening part. Thus, the weakening may be made so as to facilitate the manual tearing of the tag with minimal physical effort.

The invention will be better understood from the following description, given by way of example, with reference to the accompanying drawings, in which.

Figure 1:
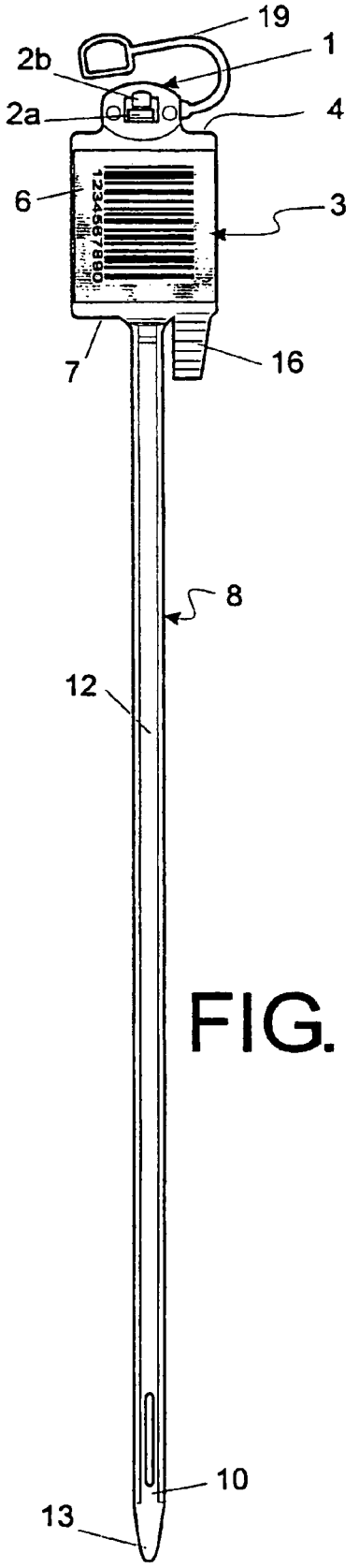
FIG. 1 is a plan view of one side of a security seal manufactured according to the present invention.
Figure 2:
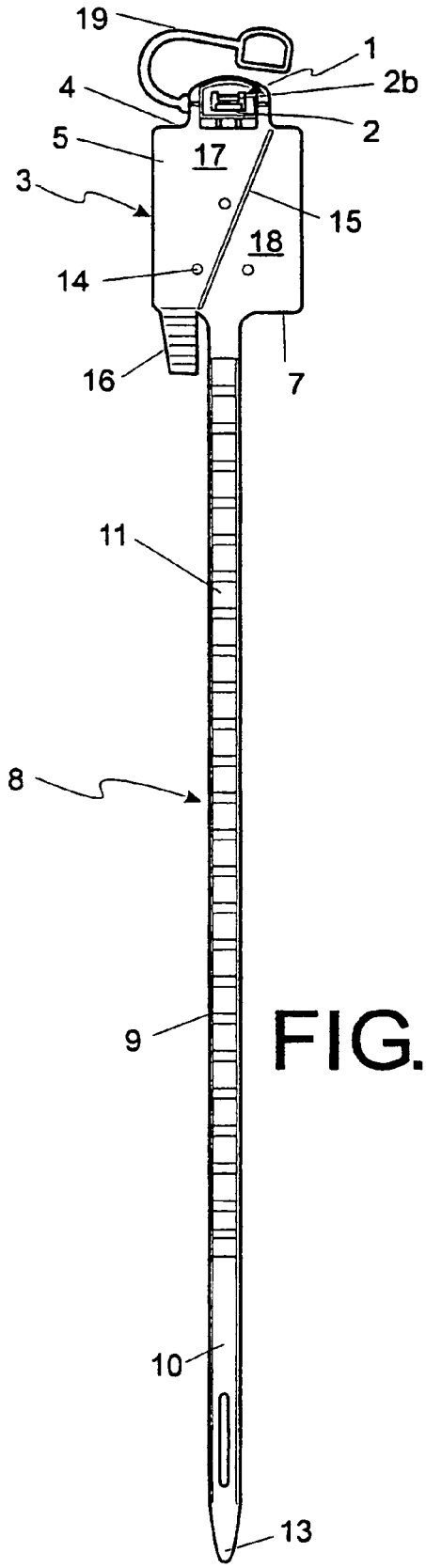
FIG. 2 is a plan view of the other side of the same security seal.

Referring to FIGS. 1 and 2 of the drawings, a security seal "pull-tight" type presenting the new features of this invention comprising a sealing body 1 forming a tunnel 2. A flexible sealing tooth 2*a* is situated on the lower side of the tunnel 2, and a ramp-shaped protuberance 2*b* is located on the opposite side.

There is, moreover, a rectangular identification tag 3 with the first edge 4. The sealing body 1 is integrated with the identification tag 3, being attached to the latter at a region approximately in the middle of edge 4. It will be seen that the sealing body 1 projects from the face 5 of the tag (FIG. 2), this face 5 being the internal face of the tag 3, that is, the face designed for facing the object being closed/fastened and sealed by the security seal. The base of the sealing body 1 is approximately in the same plane as the other face or external face 6 of the tag 3 (FIG. 1), that is to say, the face designed for facing away from the object being closed/fastened and s al d.

From the middle of the second edge 7, opposite to the first edge 4, of the identification tag, an elongated fastening part 8 extends. This fastening part 8 has a main extension 9 and a free end 10. Along the main extension 9 and part of the end 10, on the inner side (see FIG. 2) there is a series of sealing formations or teeth 11 suitable for engaging with the sealing tooth 2*a* in the tunnel 2 of the sealing body 1. As can be seen in FIG. 2, the outer side of the main extension 9 of the fastening part has a longitudinal groove 12 that receives the ramp-shaped small protuberance 2*b*, when it passes through the tunnel 2 during application of the seal.

The free end 10 of the fastening part does not have the teeth 11 and decreases in width to a free tip 13, which may be easily introduced into the tunnel 2 on the base of the sealing body 1 (FIG. 2). When the free tip 13 of the fastening part comes out at the other side of the tunnel (seen in FIG. 1), it is pulled out by hand until the loop formed by the fastening part 8 reaches the desired size or produces the adequate tension around the object being sealed (for instance, the mouth of a bag). As the tip 13 is pulled, the teeth 11 on the main extension 9 of the fastening part successively pass through the internal tooth 2*a* in the tunnel 2, the tooth elastically yielding with the passage of each tooth and then returning to the original configuration, to prevent withdrawal of the elongated fastening part. It will be understood that the engagement between the teeth represents a ratchet-like action, it being always possible to tighten the loop formed by the fastening part, but not to loosen it.

The inner face 6 of the identification tag is formed of three small sharp teeth 14, which serve to grasp at the material of a bag when the seal is used to close and seal the bag. This facilitates the tightening of the seal, preventing it from sliding around the mouth of the bag.

The inner face 6 of the identification tag 3 also posseses a weakening groove 15 and a tear-off tag 16. The groove 15 extends from a point along the first edge 4 of the tag, in an approximately diagonal direction, as far as a point at the opposite edge 7 of the tag. The tear-off tag 16 lies adjacent to the end of the groove 15 at this second edge 7. It will be seen that the weakening line or groove 15 divides the tag 3 into a first region 17, integrated with the sealing body 1 and a second region 18 integrated with the fastening part 8.

The security seal is also provided with a small tailpiece 19, ext nding from the base of the sealing body 1. This tailpiece has a ring at its free end, which can be used for fixing an address tag or the like.

Figure 3:
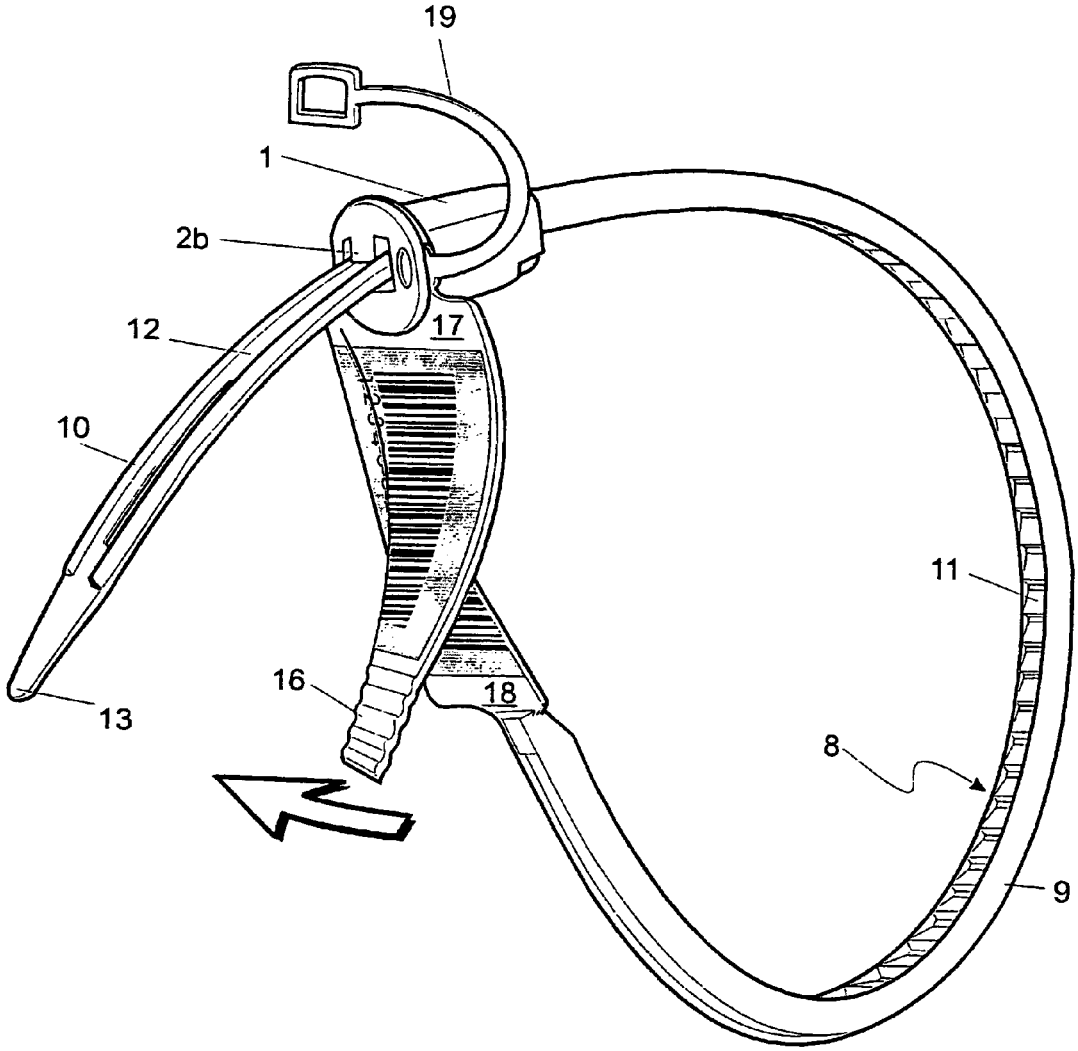
FIG. 3 is a perspective view of the security seal at the moment of being opened by tearing its identification tag.

FIG. 3 is a perspective view of the seal illustrated in FIGS. 1 and 2, in the closed configuration (without the closed obj ct) at the moment of opening or destroying the seal. FIG. 3 shows th loop formed by the fastening part 8 and the individual identification number (bar code with Arabic numerals) on the outer face 6 of the identification tag 3. At the moment of opening, as illustrated, the tear-off tag 16 has already been partly pulled and the tag 3 partly tom along the tear line or groove 15. In continuing the action of pulling tag 16, the identification tag 3 will be totally tom, from edge 7 as far as edge 4. This will split the identification tag 3, separating the first region 17 from the second region 18, and will totally destroy the identification number and open the loop formed by the closed seal. The clos d object will thus be opened without any damage, since no cutting tool has been employed for this purpose.

An essential characteristic of this invention is the fact that the tag 3 serves as a connection between the sealing body 1 and the fastening part 8, since this reduces the length of the fastening part by the distance between the edges 4 and 7 of the tag 3. In this way, the tag itself saves raw material otherwise used to form part of the fastener. This makes the manufacture of this closing seal more economical. Besides, as already mentioned, the tag with the groove 15 has a relatively high physical resistance in the direction of the length of the fastening part, but at the same time tearing it is relatively easy. Moreover, as seen from FIGS. 1 to 3, the tunnel length in the direction of fastener insertion is of a greater length than the longitudinal extension of the sealing body and also longer than any portion of the security seal body region between the free, non-fastener part end of the sealing strap and the closest edge of the tunnel. In the Figures the sealing body is also shown as having a border region extending about the tunnel having a peripheral edge, and with a portion of that peripheral edge defining a portion of the free, non-fastener part end; and the longitudinal length of the sealing body represented by opposing peripheral edge regions of the sealing body, is shown to be less than the longitudinal length of the tag. The illustrated arrangement, which positions the identification tag between the sealing body and the fastener part, also renders the sealing strip free of any parallel plane section extending on the side of the sealing body opposite the fastener strap connection side.

The above description has been made with respect to a presently preferable embodiment of this invention, and it should be understood that various modifications and alterations are possible, without departing from the basic concept of the invention. For instance, the weakening line may have any suitable shape; it is not essential for it to be a groove. It could comprise multiple small holes or tears, a combination thereof with a groove or any other weakening that enables one to tear off the tag 3. Equally, the weakening line does not need to be diagonal, nor even a straight line. Again, it is enough that it facilitates the tearing-off of the tag so as to separate the sealing body 1 from the fastening part 8.

The tearing means is constituted of the pulling tag 16 in the seal illustrated in the drawings. However, they could have other shapes, such as a pin or other type of protuberance, or even a strap or hole where a non-cutting tool (for example, a hook) could be fitted.

The other features of the seal could be modified too. For instance, the teeth in the fast ning part could be on both sides, instead of only one side, as illustrated in the mentioned Patent PI 8906110-1.

These and other modifications that do not detract from the basic concept set forth here should therefore be considered to be within the scope of the invention, which is determined by the charact ristics (and their equivalents) defined in the accompanying claims.

The invention claimed is:

1. A fastening-type security seal comprising:

a sealing body forming a tunnel containing at least one tooth;

an elongate identification tag integral with the sealing body and having a first edge and a second edge opposite said first edge, said identification tag being formed with a weakening line which extends from said first edge to said second edge of said tag, dividing the tag into a first region on one side of said weakening line and a second region on the other side of said line;

tearing means formed on said identification tag adjacent one of the ends of the said weakening line, which permit tearing of the tag, separating said first region from said second region; and an elongated fastening part having one end integral with said second edge of said identification tag and a second free end, a series of sealing formations being provided along the elongated fastening part, so that when the free end of said fastening part is inserted into the tunnel of the sealing body and pulled out at the other side of the tunnel, the sealing formations will be successively engaged with the tooth in a ratchet-like manner, preventing withdrawal of the elongated fastening part from the tunnel, wherein said sealing body is integral with said first region of said identification tag being attached thereto at said first edge of the tag, whereby said tag lies between the sealing body and the elongated fastening part, and wherein said first edge has a transverse width greater than the transverse width of said sealing body, wherein said identification tag is substantially rectangular shaped with said first and second edges defining first and second longitudinally spaced ends of the substantially rectangular shape identification tag, and first and second laterally spaced edge extensions of said identification tag defining remaining side portions of the substantially rectangular shaped identification tag, and that said weakening line extends from a point adjacent a junction between said first laterally spaced edge extension of the tag and one of said ends of the tag to a point adjacent a junction between the second opposite laterally spaced edge extension of the tag and the other end of the tag.

2. A security seal according to claim 1, characterized in that said identification tag has an identification area and that said weakening line passes through said identification area.

3. A security seal according to claim 1, characterized in that said weakening line is a straight line.

4. A security seal according to claim 1, characterized in that said weakening line comprises a groove.

5. A security seal according to claim 1, characterized in that said tearing means comprises a pulling tab.

6. A security seal according to claim 2, characterized in that said weakening line is a straight line.

7. A security seal according to claim 2, characterized in that said weakening line comprises a groove.

8. A security seal according to claim 3, characterized in that said weakening line comprises a groove.

9. A security seal according to claim 2, characterized in that said tearing means comprises a pulling tab.

10. A security seal according to claim 3, characterized in that said tearing means comprises a pulling tab.

11. A security seal according to claim 4, characterized in that said tearing means comprises a pulling tab.

12. A security seal according to claim 1, wherein said sealing body has a tunnel length along a direction of fastener part insertion greater than a length of the extension of said sealing body in a direction in common with an elongation direction of said tag.

13. A security seal according to claim 1, wherein said sealing body has a tunnel length along a direction of fastener part insertion which exceeds a length of extension of a security seal body region extending between an adjacent most free end of said security seal to a tunnel edge closest to said free end of said security seal.

14. A security seal according to claim 1, wherein said sealing body comprises a bordering region extending about an end opening of the tunnel, and the bordering region having an outer peripheral edge that defines a free end of said security seal, and with the peripheral edge having a width, in a common direction of elongation with said tag, that is less than the elongation length of said tag.

15. A security seal according to claim 1, wherein said weakening line has a length that is greater than a maximum width of said sealing body relative to a reference plane flush with a surface of said tag on which identification is provided.

16. A security seal according to claim 1, wherein said sealing body is free of any flat, parallel sided panel extension on a side of said sealing body opposite that receiving said tag.

17. A security seal according to claim 1, wherein said first edge has free edging portions extending to opposite sides of said sealing body.

18. A security seal according to claim 1, wherein the sealing body is centrally located along the first edge.

* * * * *